United States Patent [19]

Morio

[11] Patent Number: 4,478,529

[45] Date of Patent: Oct. 23, 1984

[54] WRITING IMPLEMENT WITH AUTOMATIC LEAD PROJECTION

[75] Inventor: Yasumasa Morio, Osaka, Japan

[73] Assignee: Kabushiki Kaisha Sakurakurepasu, Osaka, Japan

[21] Appl. No.: 378,041

[22] Filed: May 14, 1982

[30] Foreign Application Priority Data

May 19, 1981 [JP] Japan ..... 56-76283

[51] Int. Cl.[3] ..... B43K 21/02; B43K 21/16

[52] U.S. Cl. ..... 401/53; 401/65; 401/67; 401/81; 401/94

[58] Field of Search ..... 401/53, 65, 67, 94, 401/80, 81

[56] References Cited

U.S. PATENT DOCUMENTS

| | | | |
|---|---|---|---|
| 1,908,386 | 5/1933 | Wahl | 401/67 |
| 2,109,604 | 3/1938 | Van Norsdall | 401/53 |
| 3,424,535 | 1/1969 | Schischkow | 401/53 |
| 3,864,046 | 2/1975 | Butka | 401/53 |

FOREIGN PATENT DOCUMENTS

| | | | |
|---|---|---|---|
| 884919 | 7/1953 | Fed. Rep. of Germany | 401/67 |
| 3040726 | 5/1981 | Fed. Rep. of Germany | 401/67 |

*Primary Examiner*—Steven A. Bratlie

*Attorney, Agent, or Firm*—Jordan & Hamburg

[57] ABSTRACT

A propelling or automatic writing implement having a lead which can be projected from the implement without pushing. An inner frame having a chuck assembly for permitting advance of the lead but preventing retraction of the lead and a lead protecting tube having a holder for holding the lead with a suitable frictional force are housed in a main body and slidable axially thereof. A mechanism is provided for retracting the frame and the tube by a reaction to which the lead is subjected when pressed against the writing surface with a force of considerable magnitude and for returning them when the lead is released from the force, while permitting the tube to move backward and forward relative to the frame in the course of the reciprocating movement. The lead can be projected by the relative movement of the tube and the frame.

9 Claims, 13 Drawing Figures

WRITING IMPLEMENT WITH AUTOMATIC LEAD PROJECTION

The present invention relates to writing implements such as propelling or mechanical pencils, and more particularly to a writing implement having a lead which can be projected without the necessity of regripping the main body of the implement during writing.

Conventional propelling or mechanical pencils are generally provided at the rear end of the main body with a projecting portion which is depressed by a finger to project the lead. Such a pencil is inconvenient in that the pencil must be regripped every time the lead is to be advanced outward. Further,recently a pencil has been proposed in which the lead is automatically projectable in such manner that when a lead protecting tube having the lead extending therethrough has been retracted a predermined amount with the wear of the lead during writing, the tube is pushed back to the original position along with the lead. However, since the tube and the lead are projected almost together, it is impossible to cause the lead to project from the tube by a desired amount. Thus the proposed pencil fails to fully satisfy the need of the user. Other known devices for automatically projecting the lead also have various problems, such as being not always reliable in lead projecting operation and having a very complex construction.

An object of the present invention, which has been accomplished to overcome such drawbacks of conventional pencils, is to provide a writing implement having a lead which is easily projectable when used during writing merely by pressing the end of the lead against the writing surface or the like with writing pressure or slightly higher pressure with the implements main body held in writing position and thereafter releasing the implement from the pressure.

Another object of the invention is to provide a writing implement in which the lead can be projected reliably with a reduced likelihood of malfunction when pressed against the writing surface or the like and thereafter relieved of the pressure as above.

Another object of the invention is to provide a writing implement having a lead which can be projected as above by a relatively simple structure.

Another object of the invention is to provide a writing implement having a lead which can be projected by a desired amount in accordance with the magnitude of the force applied by the user.

Still another object of the invention is to provide a writing implement which has an engageable portion projecting outward from its main body for projecting the lead and releasing the lead from a chuck when depressed and which enables the user to project the lead by pressing the implement against the writing surface and thereafter releasing the same from such pressure, or to manipulate the engageable portion selectively as desired.

Other objects and advantages of the present invention will become apparent from the following description of embodiments with reference to the accompanying drawings, in which:

PREFERRED EMBODIMENTS OF THE INVENTION

Figure 1:
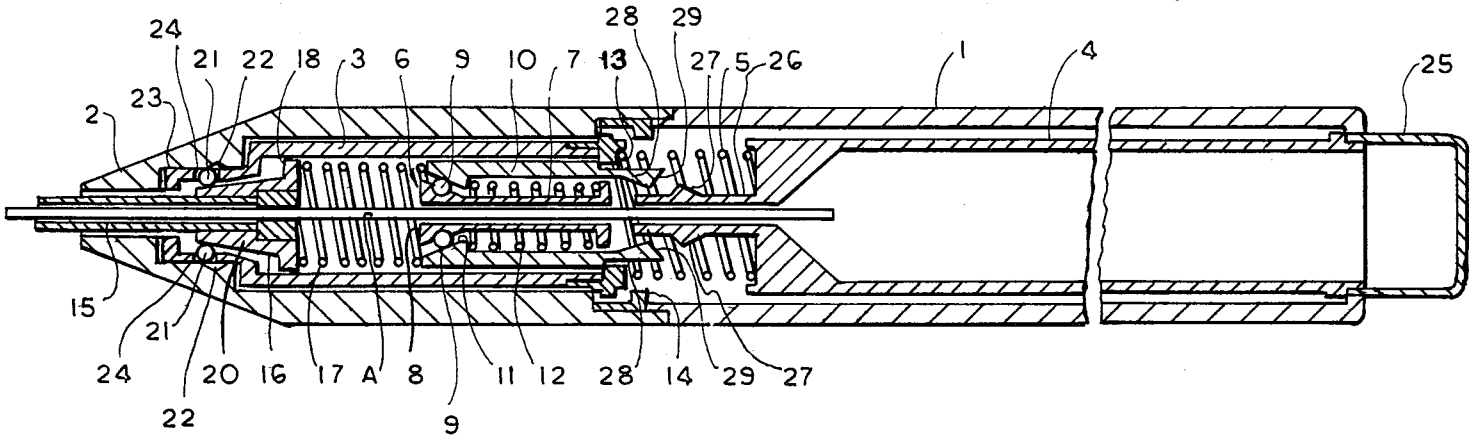
FIG. 1 is a fragmentary view in longitudinal section showing a writing implement embodying the invention.

With reference to FIG. 1 showing the overall construction of a writing implement, an implement main body 1 is substantially cylindrical and has at its forward end a head 2 which is conical in external shape. An inner frame 3 housed in the main body 1 in the form of a hollow cylinder, is slidable axially thereof over a given distance and is biased forward by a coil spring 5 provided between the frame 3 and a tubular lead container 4 in a rear interior portion of the main body 1. A chuck assembly 6 is provided in the rear portion of the inner frame 3 for preventing retraction of a lead but permitting advance of the lead. The chuck assembly 6 comprises a chuck tube 7 permitting insertion of the lead A therethrough and having a chuck portion 8 at its front end, a suitable number of balls 9 retained on the outer periphery of the chuck portion 8, a tubular chuck bearing member 10 having a rearwardly tapered inner surface 11 at its front end and a chuck spring 12 having a small biasing force. The chuck portion 8, which is expansible, comprises, for example, two divided jaws. The chuck tube 7 is housed in the bearing member 10, and the chuck spring 12 is provided between a front inner flange of the member 10 and a rear end flange of the tube 7 to hold the balls 9 in contact with the tapered surface 11. Against a force acting to retract the lead A through the chuck tube 7, the tapered surface 11 exerts a force on the balls 9, 9 to tightly grip the lead A, whereas little or no gripping force acts on the lead A when the lead is subjected to an advancing force. With the chuck assembly 6 housed in the inner frame 3, the chuck bearing member 10 is biased rearward by a spring 17 forwardly biasing the lead protecting tube 15 to be described later, and a stopper 13 is provided at the rear end of the inner frame 3 for the bearing member 10, whereby the chuck assembly 6 is retained in the rear portion of the inner frame 3. The main body 1 is formed at a specified portion of its inner surface with a stopper 14 for determining the rearmost retracted position of the frame 3.

A lead protecting tube 15 disposed in the implement main body 1 at its front end comprises a tubular main portion for inserting the lead A therethrough and an end member 16 fixed to the rear end of the main portion. With its front end extending outward from the main body head 2, the tube 15 is slidable axially thereof and is biased forward by the coil spring 17 which is interposed between the rear end of the end member 16 and the chuck bearing member 10. The protecting tube 15 internally has a lead holder 18 for holding the lead A with a suitable frictional force. While the lead holder 18 in the illustrated embodiment is a rubber ring attached to the inner surface of the end member 16, the location of the holder 18 formed in the protecting tube 15, as well as the means for forming the holder, is not limited to the illustrated example. For example, a front end portion of the protecting tube 15 may be lined with rubber to provide a lead holder.

Figure 2:
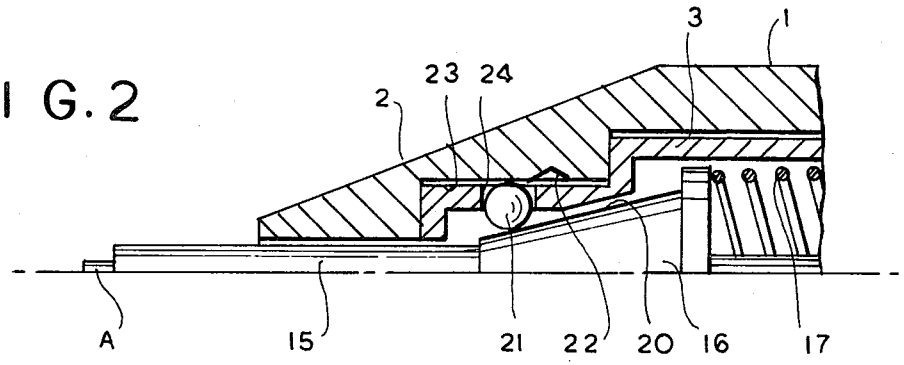
FIG. 2 is a fragmentary sectional view showing the same on an enlarged scale.

The rear portion of the tube 15 is inserted in the front portion of the inner frame 3 to provide means for projecting the lead A in accordance with the pressure applied to the front end of the lead as will be described later. The projecting means or mechanism is provided by the rear portion of the tube 15, the front portion of the frame 3 and the inner surface of the main body 1 which are movable relative to one another. As seen in FIGS. 1 and 2, the means comprises a tapered surface 20 formed on the outer periphery of the rear member 16 of the tube 15, balls 21, 21 serving as rolling members and retained by the front portion of the inner frame 3, and guide portions 22, 22 formed in the inner peripheral surface of the main body 1 for guiding the movement of the balls 21, 21. Thus the end member 16 at the rear portion of the protecting tube 15 has the tapered outer peripheral surface 20 having a diameter increasing rearward. The front portion of the inner frame 3 is positioned in a hollow portion 23 formed in the main body head 2, and a ball retaining bore or bores 24, 24 are formed in the frame front portion at one location or several locations (two in the illustrated case) as spaced apart suitably circumferentially thereof. The balls 21, 21 are retained in the bores 24, 24 and are inwardly and outwardly movable radially of the frame 3. Rolling members of some other suitable shape, such as short solid cylinders, are usable in place of the balls 21, 21. Inside and outside the inner frame 3, the balls 21, 21 are in contact with the tapered surface 20 and the inner peripheral surface of the main body 1 defining the hollow portion 23. The guide portions 22, 22 for moving the balls 21, 21 radially inward or outward with the axial movement of the inner frame 3 are formed in the inner periphery of the main body 1 defining the hollow portion 23. In the present embodiment, each of the movement guide portions 22, 22 is in the form of an approximately V-shaped recess formed at a location corresponding to the position of the ball 21 when the inner frame 3 is moved to an intermediate position within its axially movable range. Except where the guide portions 22, 22 are formed, the hollow portion defining inner periphery of the main body 1 has a uniform diameter over a specified axial length thereof.

The implement further has an advancing mechanism for facilitating withdrawal of the lead A from the tubular lead container 4. Stated more specifically, the container 4, which is rearwardly biased by the coiled spring 5, is axially slidable and has an advancing or pushing cap 25 attached to its rear end and a lead guide tube 26 extending from its front end. A suitable number of projections 27, 27 for pushing the chuck bearing member 10 are formed on the outer periphery of the tube 26 at an intermediate portion thereof. Resilient pieces 28, 28 extending from the rear end of the chuck bearing member 10 and tiltable inward or outward radially thereof are formed on the inner side with projections 29, 29 to be pushed by the above projections 27, 27 in corresponding relation. The projections 27, 27 and 29, 29 are suitably sloped or rounded on their opposed faces to come into contact with each other when the container 4 is advanced some distance. Further when the bearing member 10 advances a predetermined distance, compressing the spring 17 acting thereon and causing a force corresponding to the resulting force of the spring 17 to press the projections 27, 27 against the projections 29, 29 axially of the implement, these projections pass over each other.

The operation of the writing implement will be described below. The force of the coil spring 5 for biasing the inner frame 3 forward and the force of the coil spring 17 for biasing the lead protecting tube 15 forward are preferably so determined that under the usual writing pressure, the inner frame 3 is retracted until the balls 21 reach the guide portions 22 but will not be retracted to such an extent that the balls 21 pass over the guide portions 22. Further it is desired that the lead holding force afforded by the holder 18 of the protecting tube 15 be smaller than the force of the spring 17 biasing the tube 15 forward. The writing implement under these conditions will be further described with reference to Figs. 3 to 8 as to its state during writing and also with respect to a lead projecting procedure which can be carried out with the main body 1 held in the writing position.

Figure 3:
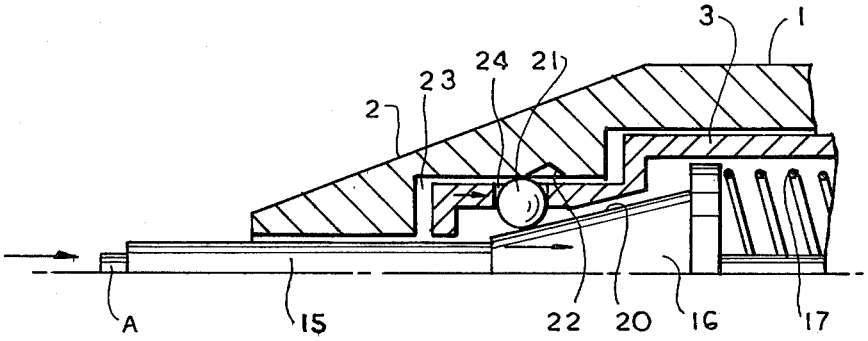
FIGS. 3 to 8 are fragmentary enlarged sectional views showing stepwise the operation of an automatic lead projecting mechanism included in the writing implement.
Figure 4:
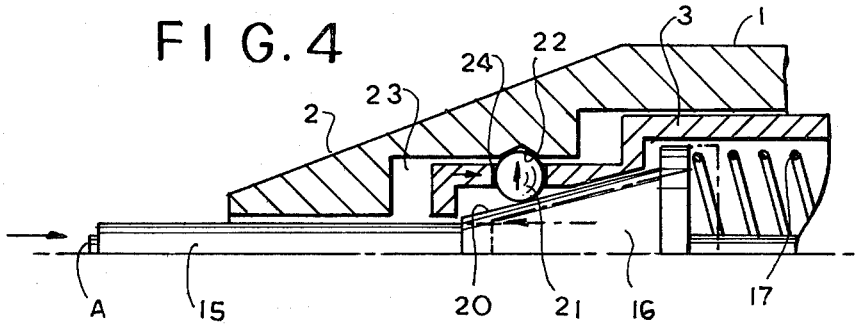

It is now assumed that a lead A has been withdrawn from the container 4 and projected from the protecting tube 15. During writing, the lead A is held by the chuck assembly 6 against the writing pressure. In this case, the writing pressure acting on the tip of the lead A is delivered through the chuck assembly 6 to the inner frame 3, retracting the inner frame 3 with the lead A and causing the balls 21 to retract the protecting tube 15 with the inner frame 3 as seen in FIG. 3. When the inner frame 3 is retracted by a predetermined amount, the balls 21 engage in the guide portions 22 formed in the inner periphery of the main body 1 to hold the frame 3 in this position under the usual writing pressure as shown in Fig. 4. At this time, the outward movement of the balls changes the position of contact of the tapered surface 20 with the balls 21, permitting the spring 17 to move the tube 15 forward relative to the inner frame 3, but with the frame 3 maintained in a definite position relationship with the lead A under the writing pressure, the tube 15 alone moves relative thereto. When the implement is relieved of the writing pressure, the parts return to the original state in a manner reverse to the above. The usual writing operation is performed in the state shown in FIG. 4. Although the tube 15 covers the lead A due to the relative movement thereof in this state, the tube 15 is retractable with the wear of the lead A, permitting writing.

Figure 5:
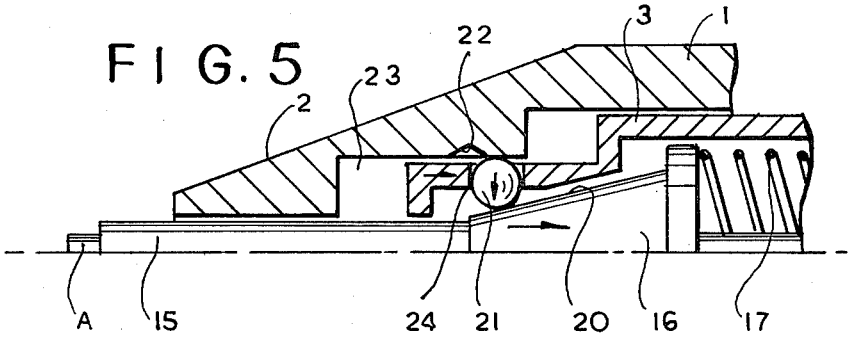
Figure 6:
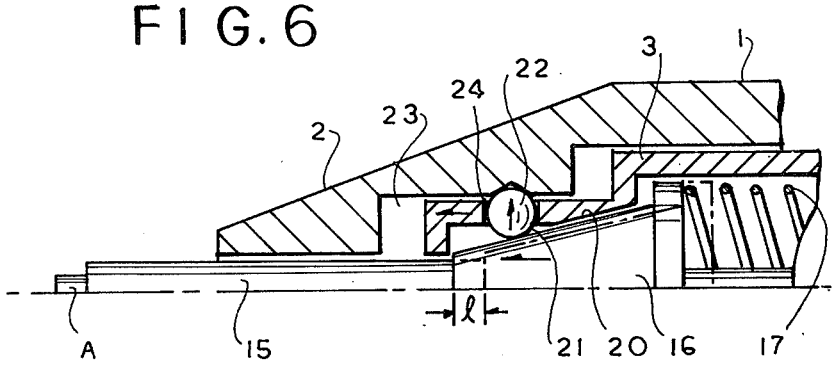
Figure 7:
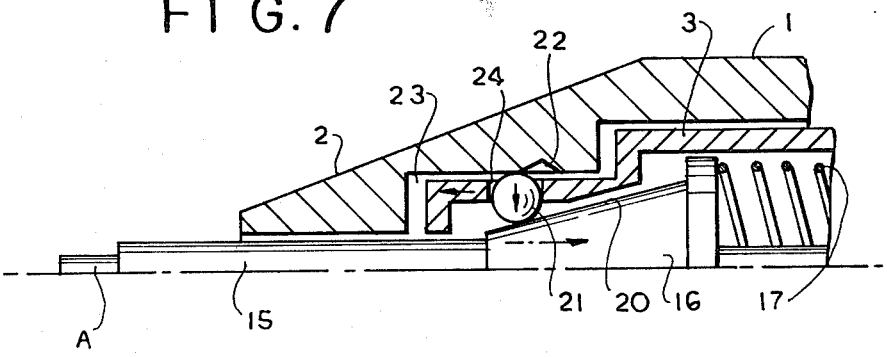
Figure 8:
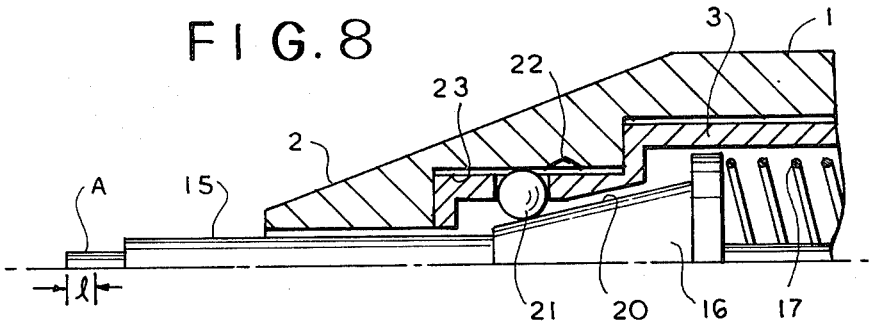

When the user desires to further project the lead A from the above state, the tip of the lead A is pressed against the writing surface with a force somewhat greater than the usual writing pressure, with the main body 1 held in the writing posture, whereby the inner frame 3 is retracted as seen in FIG. 5 by way of the steps shown in FIGS. 3 and 4 described above. If the pressure is sufficiently great, the balls 21 move over the guide portions 22. At this time, each ball 21 moves inward from the position shown in FIG. 4, consequently changing the position of contact of the tapered surface 20 with the ball 21 and thereby retracting the protecting tube 15 relative to the frame 3, with the result that the tube 15, the frame 3 and the lead A are returned to the original position relative to one another. When the lead A is thereafter released from the pressure applied to its tip, the frame 3 and the tube 15 are returned to the original position by the restoring forces of the springs 5 and 17. As in the course of retraction, the ball 21 moves outward to engage in the guide portion 22 as seen in FIG. 6 during the movement of the inner frame 3, thereby causing the protecting tube 15 to move forward relative to the frame 3 by a distance l. At this time, however, no pressure is applied to the tip of the lead A which is allowed to advance by the chuck assembly 6, so that the lead A advances with the tube 15 by virtue of the frictional force of the holder 18. Thus, the lead A advances also relative to the frame 3. When the ball 21 further moves past the guide portion 22, the tube 15 moves rearward relative to the frame 3 as seen in FIG. 7, with the lead A prevented from retraction by the chuck assembly 6. Consequently the lead A is projected from the tube 15 relative thereto. Eventually the lead A is projected from the previous position by a length l corresponding to the distance of forward movement of the tube 15 relative to the frame 3 as seen in FIG. 8.

The lead is projected as described above when the lead tip is subjected to a pressure which is sufficiently great to cause the ball 21 to completely pass over the guide portion 22 during the retraction of the inner frame 3. If the pressure is lower but is higher than the usual writing pressure, the pressure comes into balance with the force acting thereagainst when the ball 21 comes to an intermediate portion of the slope between the deepest point of the guide portion 22 and the end of the portion 22 in the course of retraction of the frame 3, whereupon the ball stops. The position of the stop of the ball 21 is dependent on the pressure. The lead A is projected by the return step following the removal of the pressure, by an amount corresponding to the distance from the deepest point of the guide portion 22 to the stopped position of the ball. Accordingly the amount of projection of the lead can be adjusted as desired by controlling the magnitude of the force with which the lead tip is pressed against the writing surface or the like.

Figure 9A:
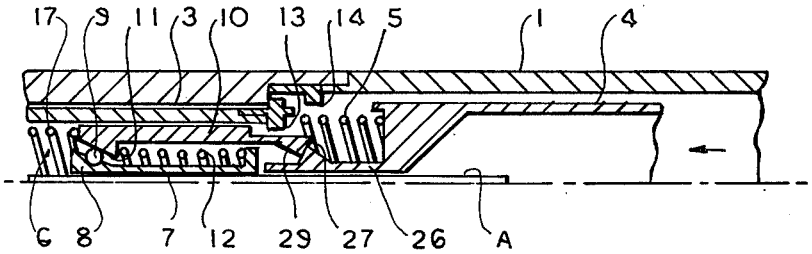
FIGS. 9 (*a*) and (*b*) are fragmentary sectional views showing stepwise the operation of an advancing mechanism included in the implement.
Figure 9B:
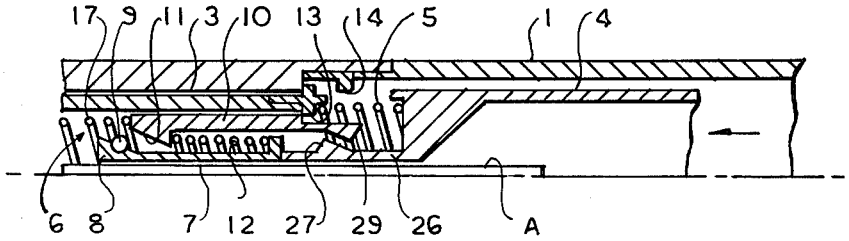

According to the foregoing embodiment, the lead A can be projected also by pushing. When the cap 25 at the rear end of the container 4 is knocked to advance the container 4, the projection 27 comes into contact with the projection 29 first as seen in FIG. 9 (*a*), pushing the chuck assembly 6 to project the lead A. When the chuck assembly 6 advances some distance, the projections 27 and 29 pass over each other as shown in FIG. 9 (*b*), permitting the chuck bearing member 10 to retract and causing the front end of the guide tube 26 to push the chuck tube 7 alone forward, whereby the lead is released from the chuck. The lead A is left in the projected position when the container 4 and the chuck tube 26 return. To withdraw a lead A from the tubular container 4, for example, when the implement is to be used for the first time, the cap 25 is advanced to bring the chuck assembly to the disengaged state shown in FIG. 9 (*b*) with the implement forward end directed downward, allowing the lead A to slide down to its neighborhood of the holder 18 in the protecting tube 15. The lead A can be easily projected from the tube 15 subsequently by knocking the cap 25 or carrying out the projecting procedure shown in FIGS. 3 to 8 and already described. When desired, the lead A can be retracted by releasing the lead from the chuck assembly by pushing and then forcing the lead into the implement.

The construction of the writing implement of this invention is not limited to the foregoing embodiment but can be modified variously as will be described below for illustrative purposes.

Although the guide portion 22 formed inside the implement main body 1 for guiding the movement of the ball is a recess in the above embodiment, the guide portion may be in the form of an inverted V-shaped projection or the like. When the ball 21 is to pass over the guide portion with the axial movement of the inner frame 3 in this case, the ball 21 first rides onto the projecting guide portion and therefore moves inward to shift the position of contact of the tapered surface 20 of the protecting tube 15 with the ball 21 forward, moving the tube 15 rearward relative to the inner frame 3. Subsequently when the ball 21 passes over the projecting guide portion, the tube 15 moves forward relative to the frame 3. The lead A projects from the tube 15 under the action of the chuck assembly 6 also in this case when the tube 15 rearwardly moves relative to the inner frame 3 in the course of return upon the release of the lead tip from the pressure applied thereto, the lead A advancing with the tube 15 when the tube 15 moves forward relatively. Thus the lead A is projected. While the guide portion 22 of the above embodiment is formed at the location corresponding to an intermediate position of the ball 21 in its to-and-fro movable range, the guide portion may be formed inside the main body 1 by a gentle slope having a gradually varying amount of indentation or projection over an area corresponding approximately to the entire movable range of the ball 21. Furthermore, the guide portion may comprise a plurality of undulating or wavy indentations or projections which are arranged axially of the main body to cause the ball 21 to repeatedly move inward and outward radially of the main body in the course of its displacement. The number of indentations or projections of the guide portion over which the ball 21 passes, i.e. the number of times the ball 21 moves radially inward and outward, then changes with the magnitude of the pressure applied to the lead tip, consequently varying the amount of projection of the lead as desired. The arrangement is therefore useful for adjusting the amount of projection. Briefly, insofar as the guide portion is so shaped as to move the ball 21 radially inward and outward when the ball 21 is displaced axially of the main body, irrespective of which of the outward movement and inward movement takes place first and regardless of the number of times of such movement, the lead A can be projected by the axial movement of the protecting tube 15 relative to the inner frame 3 and resulting from the movement of the ball 21.

The advancing mechanism need not always have the lead projecting function; the projections 27 and 29 may be eliminated so that the advancing mechanism merely acts to release the lead from the gripping engagement of the chuck assembly 6 for withdrawing the lead A from the container 4 or for retracting the lead into the implement. An advancing mechanism already known for use in propelling pencils of the knock type is also usable. The chuck assembly is not limited to the one included in the embodiment; a ball chuck, etc. are usable.

Figure 11:
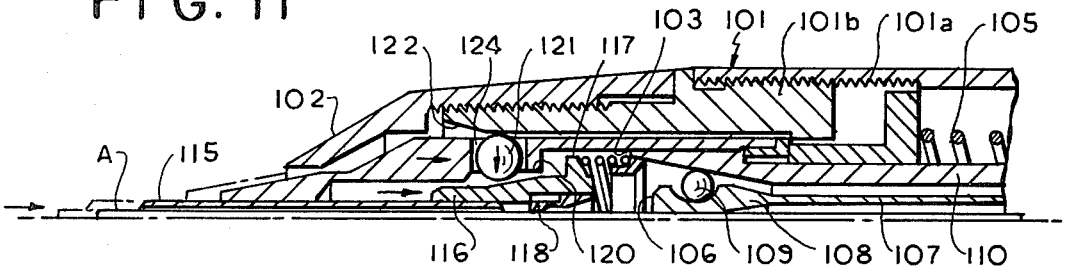
FIGS. 11 and 12 are fragmentary sectional views showing stepwise the lead projecting operation of the embodiment shown in FIG. 10.
Figure 10:
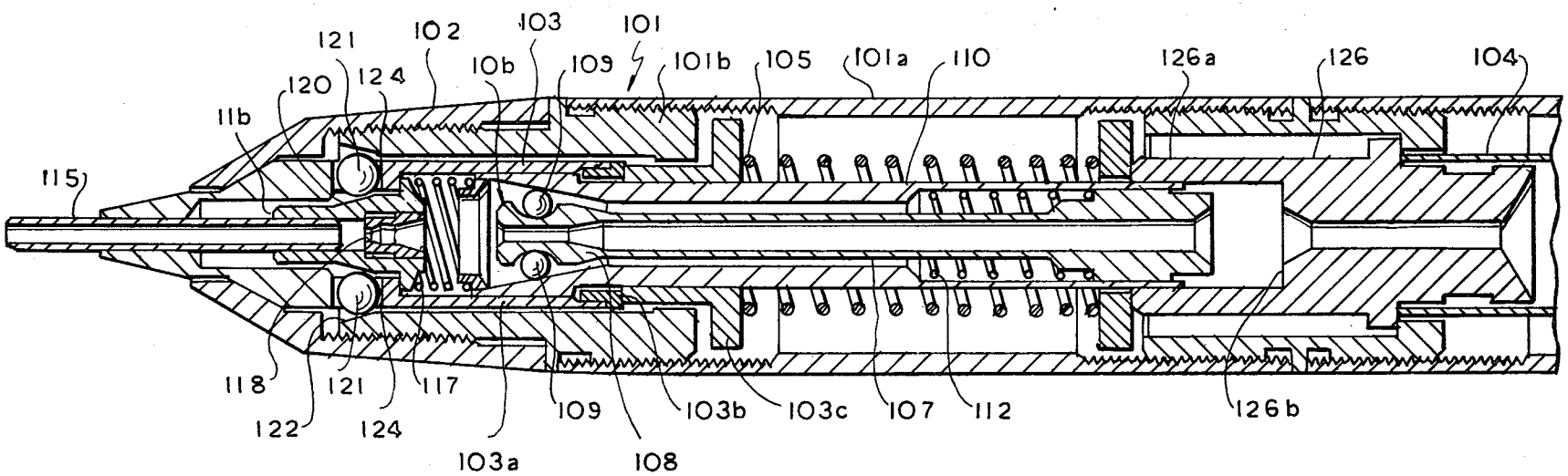
FIG. 10 is a fragmentary sectional view showing another embodiment of the invention.
Figure 12:
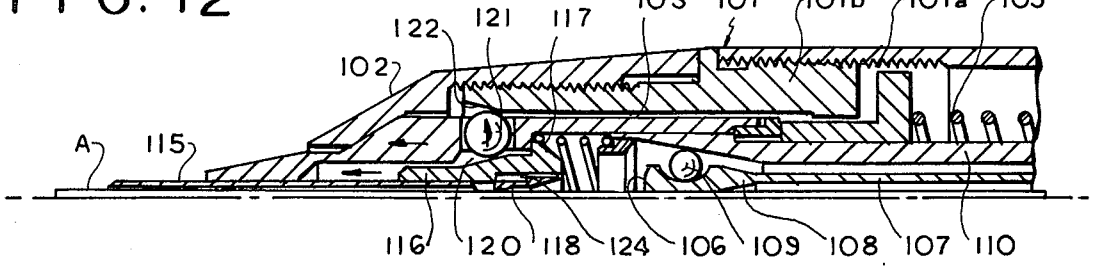

FIGS. 10 to 12 show another embodiment of the invention. An inner frame 103 provided with a chuck assembly 106 and a lead protecting tube 115 provided with a lead holder 118 are forwardly biased by a coil spring 105 and a coil spring 117, respectively, housed in a implement main body 101 and slidable axially thereof. The tube 115 has a rear portion **11*b* inserted in the inner frame 103 and an end member 116 fixed to its rear end and formed with an outer peripheral tapered surface 120. The frame 103 has bores 124, 124 having balls 121, 121 retained therein and movable inward and outward radially of the frame. The second embodiment is similar to the first in respect of the above arrangement. However, the main body 101 comprises a head 102** and a truck 101*a* which are connected together by a connecting member 101*b* having a front end portion screwed in the head 102. A rearwardly tapered guide portion 122 is formed on the inner periphery of the connecting member 101*b* at its front end. The balls 121, 121 are held in contact with the tapered surface of the guide portion 122 and the tapered surface 120 of the end member 116 at the rear end of the lead protecting tube 115. The inner frame 103 comprises a main portion 103*a*, a ring 103*b* fitted to the rear end of the main portion 103*a* and a rear end member 103*c* ring against the ring 103*b*. The frame main portion 103*a* has a front end projecting forward from the head 102, with the tube 115 projecting further forward from the main portion 103*a*. As in the foregoing basic embodiment, the chuck assembly 106 comprises a chuck tube 107 having an expansible chuck portion 108 at its front end, a suitable number of balls 109 arranged on the outer periphery of the chuck portion 108, in front of shoulder 10*b* a chuck bearing member 110 and a chuck spring 112. The assembly permits the advance of a lead but prevents the retraction of the lead. The advancing mechanism comprises a tubular lead container 104 having a pusher portion (not shown) at its rear end, and a lead guide member 126 attached to the front end of the container 104 and is slidable over a specified range axially of the main body as biased rearward by the coil spring 105. The lead guide member 126 includes at its front end a tubular portion 126*a* fitting around the rear end of the chuck bearing member 110 in suitable frictional contact therewith. The chuck tube 107 has a rear end rearwardly projecting from the rear end of the bearing member 110 to oppose an intermediate stepped portion 126*b* of the member 126. When pushed, the lead guide member 126 advances the chuck assembly 106 in its entirety to a predetermined position and thereafter moves forward in sliding contact with the bearing member 110, thereby pushing the chuck tube 107 forward to release the lead therefrom.

FIGS. 11 and 12 show the lead projecting operation of the embodiment effected by the application of pressure to the lead tip and removal of the pressure. When the chuck assembly 106 gripping the lead A and the inner frame 103 are retracted by a magnitude of pressure applied to the tip of the lead A, the ball 121 moves inward along the guide portion 122, retracting the lead protecting tube 115 relative to the inner frame 103 and permitting the lead A to project a specified amount relative to the tube 115. When the inner frame 103 and the chuck assembly 106 subsequently advance to the original position upon the removal of the pressure, the ball 121 moves inward along the guide portion 122, allowing the tube 115 to advance relative to the frame 103 to project the lead A with the tube 115. Thus the ball 121 moves radially inward and outward with the backward and forward movement of the inner frame 103, causing the tube 115 to slide backward and forward relative to the frame 103 to thereby project the lead A.

To sum up, the writing implement of the present invention comprises an inner frame and a lead protecting tube each biased forward and housed in its main body slidably axially thereof, the inner frame being provided with a chuck assembly for permitting advance of a lead but preventing retraction of the lead, the tube having a holder for holding the lead with a suitable frictional force and a rear portion formed with a tapered outer peripheral surface, at least one rolling member being retained by the frame in contact with the tapered surface and with the main body inner surface and movable inward and outward radially of the main body, a guide portion being formed in the main body inner surface for guiding the movement of the rolling member, such that the tube is moved axially rearward and forward relative to the frame by a radially inward and outward movement of the rolling member when the frame and the tube are moved rearward and forward. Accordingly when the tip of the lead is pressed against the writing surface by a pressure and thereafter released from the pressure, the lead is projected from the implement by the axial movement of the tube relative to the frame during the return. Thus the lead can be projected by a desired amount with the implement main body held in writing position, while the amount of projection is adjustable as desired by controlling the pressure. The implement has a relatively simple construction and operates reliably with a reduced likelihood of malfunctioning. When the lead projecting mechanism is in combination with a pusher mechanism for releasing the lead from the chuck assembly and for projecting the lead, one of the mechanisms can be used selectively as desired for withdrawing a lead before writing, for projecting the lead when it is worn during writing or for retracting the lead into the main body.

Thus the writing implement of the invention has various useful advantages.

What is claimed is:

1. A writing implement utilizing lead and in which the lead is automatically advanced by applying pressure to the lead greater than normal writing pressure and subsequently releasing said pressure to effect said automatic advance, comprising a tubular main body, an inner frame and a lead protecting tube axially slidable in said body, a first coil spring at a rear portion of said body biasing said frame forwardly, a second coil spring within said frame and disposed rearwardly of said protecting tube to bias said protecting tube forwardly, a clutch assembly in said frame operable to permit advance of said lead but preventing retraction of said lead, said protecting tube having a lead holder for holding said lead with a frictional force, said protecting tube having a rear end portion disposed in said frame, said second coil spring biasing said rear end portion forwardly, said rear end portion having an outer peripheral surface which is tapered and which increases in diameter toward its rear end, at least one rolling member movable with said frame and in contact with said tapered surface, a guide means on said body spaced from said tapered surface, said rolling member being disposed between said guide means and said tapered surface, said guide means having a guide portion in which said rolling member is allowed to be displaced radially inwardly and outwardly, said frame having a first position in said body wherein said rolling member is in a first position located at said guide portion such that said rolling member is displaced radially outwardly at said guide portion, said frame being slidable into said body to a second portion when pressure greater than normal writing pressure is applied to the lead, said rolling member moving radially inwardly and then rearwardly of said guide portion when said pressure is applied to a second portion rearwardly of said guide portion, whereby upon release of said pressure, said first and second coil springs are operable to move said frame forwardly to said first position at which said rolling member is disposed at said guide portion to move radially outwardly such that the protecting tube moves forwardly relative to said frame to withdrawn the lead relative to said frame as said lead is grasped with a frictional force by said lead holder, with subsequent advancement of said frame causing said rolling member to be moved radially inwardly as said rolling member moves forwardly of said guide portion whereupon said protecting tube is moved rearwardly relative to said frame as said lead is held by said clutch assembly and the frictional force of said lead holder is overcome, whereby the lead is automatically advanced relative to said protecting tube when said pressure is released.

2. A writing implement as defined in claim 1 which further comprises an advancing mechanism including an advancing portion projecting rearward from the main body, said advancing portion being coupled to the clutch assembly to release the lead from the assembly when manipulated.

3. A writing implement as defined in claim 2 wherein the advancing mechanism releases the lead from the clutch assembly after pushing the clutch assembly a specified amount by the manipulation of the advancing portion.

4. A writing implement according to claim 1, wherein said rear end portion has a rubber ring internally attached thereto and serving as said lead holder.

5. A writing implement as defined in claim 1, wherein said protecting tube is formed on its inner surface with a rubber lining serving as the lead holder.

6. A writing implement as defined in claim 1, wherein said rolling member is a ball.

7. A writing implement as defined in claim 1, wherein said rolling member is a short solid cylinder.

8. A writing implement as defined in claim 1, wherein said guide portion is in the form of an approximately V-shaped recess.

9. A writing implement as defined in claim 1, wherein said guide portion has a rearwardly tapered surface.

* * * * *